US006508552B1

(12) United States Patent
Steinfield et al.

(10) Patent No.: US 6,508,552 B1
(45) Date of Patent: Jan. 21, 2003

(54) PRINTER HAVING PRECISION INK DRYING CAPABILITY AND METHOD OF ASSEMBLING THE PRINTER

(75) Inventors: Steven W Steinfield, San Diego, CA (US); Ronald A. Askeland, San Diego, CA (US); Jason R Arbeiter, Poway, CA (US)

(73) Assignee: Hewlett-Packard Co., Palo Alto, CA (US)

( * ) Notice: Subject to any disclaimer, the term of this patent is extended or adjusted under 35 U.S.C. 154(b) by 0 days.

(21) Appl. No.: 10/044,198

(22) Filed: Oct. 26, 2001

(51) Int. Cl.[7] ..... B41J 2/01
(52) U.S. Cl. ..... 347/102
(58) Field of Search ..... 347/102, 101, 347/104, 105, 106, 107, 43, 4; 399/320; 346/25; 219/216; 101/488; 34/304, 381; 516/70; 8/471

(56) References Cited

U.S. PATENT DOCUMENTS

| | | | |
|---|---|---|---|
| 3,946,398 | A | 3/1976 | Kyser et al. |
| 4,381,946 | A | 5/1983 | Uehara et al. |
| 4,500,895 | A | 2/1985 | Buck et al. |
| 4,771,295 | A | 9/1988 | Baker et al. |
| 4,794,409 | A | 12/1988 | Cowger et al. |
| 5,278,584 | A | 1/1994 | Keefe et al. |
| 6,022,104 | A | 2/2000 | Lin et al. |
| 6,132,038 | A | 10/2000 | Szlucha |
| 6,256,903 | B1 | 7/2001 | Rudd |
| 6,264,321 | B1 | 7/2001 | Bugner et al. |
| 6,283,590 | B1 | 9/2001 | Peter |
| 6,290,351 | B1 | 9/2001 | Merz |
| 6,293,638 | B1 | 9/2001 | McDonald |

*Primary Examiner*—Raquel Yvette Gordon
(74) *Attorney, Agent, or Firm*—Walter S. Stevens

(57) ABSTRACT

A printer having precision ink drying capability and method of assembling the printer. The printer comprises a print head that is adapted to eject a plurality of ink drops through outlet orifices defined by the print head. The ink drops form a plurality of ink marks at a plurality of locations on a recording medium positioned opposite the outlet orifices. A plurality of heaters is disposed near the print head for heating the ink marks on the recording media in order to dry the ink marks. Drying the ink marks fixes the ink to the recording media. A plurality of sensors, that are disposed near the print head are also coupled to respective ones of the heaters for sensing the locations of the ink marks on the recording media. In addition, a controller interconnects each of the heaters to respective ones of the sensors for selectively energizing the heaters according to the locations of the ink marks sensed on the recording media by the sensors. Thus, the controller selectively informs the heaters of the locations of the ink marks on the recording media as the sensors sense the ink marks. In this manner, the heaters dry only the locations having ink marks with optimized energy output.

48 Claims, 13 Drawing Sheets

PRINTER HAVING PRECISION INK DRYING CAPABILITY AND METHOD OF ASSEMBLING THE PRINTER

BACKGROUND OF THE INVENTION

The present invention generally relates to printer apparatus and methods and more particularly relates to a printer having precision ink drying capability and method of assembling the printer.

An ink jet printer produces images on a recording medium by ejecting ink droplets onto the recording medium in an image-wise fashion. The advantages of non-impact, low-noise, low energy use, and low cost operation in addition to the ability of the printer to print on plain paper are largely responsible for the wide acceptance of ink jet printers in the marketplace.

Ink jet printers comprise a print head that includes a plurality of ink ejection orifices. At every orifice a pressurization actuator is used to produce an ink droplet. In this regard, either one of two types of actuators may be used. These two types of actuators are heat actuators and piezoelectric actuators. With respect to piezoelectric actuators, a piezoelectric material is used. The piezoelectric material possesses piezoelectric properties such that an electric field is produced when a mechanical stress is applied. The converse also holds true, that is, an applied electric field will produce a mechanical stress in the material. Some naturally occurring materials possessing this characteristic are quartz and tourmaline. The most commonly produced piezoelectric ceramics are lead zirconate titanate, lead metaniobate, lead titanate, and barium titanate. When a piezoelectric actuator is used for inkjet printing, an electric pulse is applied to the piezoelectric material causing the piezoelectric material to bend, thereby squeezing an ink droplet from an ink body in contact with the piezoelectric material. The ink droplet thereafter travels toward and lands on the recording medium. One such piezoelectric inkjet printer is disclosed by U.S. Pat. No. 3,946,398 titled "Method And Apparatus For Recording With Writing Fluids And Drop Projection Means Therefor" issued Mar. 23, 1976 in the name of Edmond L. Kyser, et al.

With respect to heat actuators, such as found in thermal ink jet printers, a heater placed at a convenient location heats the ink and a quantity of the ink phase changes into a gaseous steam bubble. The steam bubble raises the internal ink pressure sufficiently for an ink droplet to be expelled towards the recording medium. Thermal inkjet printers are well-known and are discussed, for example, in U.S. Pat. No. 4,500,895 to Buck, et al.; U.S. Pat. No. 4,794,409 to Cowger, et al.; U.S. Pat. No. 4,771,295 to Baker, et al.; U.S. Pat. No. 5,278,584 to Keefe, et al.; and the Hewlett-Packard Journal, Vol. 39, No. 4 (August 1988), the disclosures of which are all hereby incorporated by reference.

The print head itself may be a carriage mounted print head that reciprocates transversely with respect to the recording medium (i.e., across the width of the recording medium) as a controller connected to the print head selectively fires individual ones of the ink ejection chambers, in order to print a swath of information on the recording medium. After printing the swath of information, the printer advances the recording medium the width of the swath and the print head prints another swath of information in the manner mentioned immediately hereinabove. This process is repeated until the desired image is printed on the recording medium. Alternatively, the print head may be a pagewidth print head that is stationary and that has a length sufficient to print across the width of the recording medium. In this case, the recording medium is moved continually and normal to the stationary print head during the printing process.

Inks useable with piezoelectric and thermal ink jet printers, whether those printers have carriage-mounted or page-width print heads, are specially formulated to provide suitable images on the recording medium. Such inks typically include a colorant, such as a pigment or dye, and an aqueous liquid, such as water, and/or a low vapor pressure solvent. More specifically, the ink is a liquid composition comprising a solvent or carrier liquid, dyes or pigments, humectants, organic solvents, detergents, thickeners, preservatives and other components. Moreover, the solvent or carrier liquid may be water alone or water mixed with water miscible solvents such as polyhydric alcohols, or organic materials such as polyhydric alcohols. Once applied to the recording medium, the liquid constituent of the ink is removed from the ink and recording medium by evaporation or polymerization in order to fix the colorant to the recording medium. In this regard, the liquid constituent of the ink is removed by natural air drying or by active application of heat. Various liquid ink compositions are disclosed, for example, by U.S. Pat. No. 4,381,946 titled "Ink Composition For Ink-Jet Recording" issued May 3, 1983 in the name of Masafumi Uehara, et al.

As previously mentioned, the colorant is heated in order to fix the colorant to the recording medium. Fixing the colorant to the recording medium avoids offsetting of the liquid colorant onto surfaces coming into contact with the printed recording medium. In this regard, there are three distinct methods for heating the colorant. These methods are convection, radiation and conduction. With respect to convection, a heated gas, such as heated air or nitrogen, is blown onto the colorant on the recording medium. However, use of convective heating is thermally inefficient because air and nitrogen have relatively low heat capacities. Thus, relatively high volumes of the air or nitrogen is necessary to transfer sufficient heat to the colorant. Also, relatively large amounts of heat are required in convective heating systems. That is, the air or nitrogen is usually supplied from an external source where the air or nitrogen is stored at a lower temperature. Thus, a significant amount of heat energy must be supplied to the large volumes of the air or nitrogen in order to raise the temperature of the air or nitrogen sufficiently to dry the colorant. Therefore, a problem in the art is the large volumes of gas and large amounts of energy needed in blower-type colorant drying systems.

Radiation heating transfers heat by electromagnetic waves and occurs when two or more spaced-apart objects are at different temperatures. In the prior art, radiation heating of colorants on recording media is typically accomplished by means of infra-red energy applied to the colorant.

Conductive heating typically requires a heating member that contacts the recording medium to fix the colorant to the recording medium. In this regard, the recording medium may be advanced around a hollow drum having hot oil or high-pressure steam in the hollow portion of the drum. The drum can also be heated electrically by radiation or resistive heaters. The drum conducts heat to the recording medium contacting the drum. However, because the drum must sealingly accommodate the hot oil or high-pressure steam, the drum is complex and costly to manufacture. Also, the drum conducts the same amount of heat along the entire width and length of the recording medium regardless of the varying drying requirements of the recording medium. In other words, the same heat is received by areas of the recording medium not having colorant as well as by areas having colorant thereat. Applying heat to areas of the recording medium not having colorant thereat wastes energy. Also, areas of the recording medium that are heavily wetted by the colorant may not receive sufficient heat energy to dry the colorant. Therefore, another problem in the art is applying the same amount of heat to all locations on the recording medium regardless of whether colorant is present at those locations.

An attempt to address the problems recited hereinabove is disclosed by U.S. Pat. No. 6,256,903 titled "Coating Dryer System" issued Jul. 10, 2001 in the name of Paul D. Rudd. The Rudd device is directed to a drying system in which a substrate is supported about a thermally conductive drum having a plurality of energy emitters disposed circumferentially within the conductive drum at locations along a length of the drum. The plurality of energy emitters are controlled to selectively emit energy along the length of the conductive drum. Moreover, the dryer system preferably includes means for sensing temperatures of the drum along the length of the conductive drum, wherein the energy emitted by the energy emitters along the length of the drum varies based upon the sensed temperatures long the length of the drum. In one preferred embodiment of the Rudd device, the energy emitters comprise annular thin band heaters. Thus, the energy emitters extend along the entire inner circumferential surface of the drum and are positioned side-by-side so as to extend along a substantial portion of the length of the drum. Each annular energy emitter has a diameter comprised for sufficiently encirculating the entire inner diameter of the drum. However, the Rudd patent does not disclose that the energy emitted by the energy emitters varies around the circumference of the drum. Rather, the Rudd patent discloses that the energy emitted by the energy emitters varies merely along the length of the drum. Therefore, the Rudd patent does not appear to disclose control of heat around the circumference of the drum. Thus, in the case of a printed recording medium, a line of printed marks extending the width of the substrate in contact with the drum will receive the same heat input regardless of whether only some locations of the printed line have colorant to be dried. As previously mentioned, applying heat to areas not having colorant thereat wastes energy.

Therefore, what is needed is a printer having precision ink drying capability and method of assembling the printer.

SUMMARY OF THE INVENTION

The present invention resides in a printer having precision ink drying capability, comprising a print head adapted to form an ink mark at a location on a recording media; a dryer associated with the print head for drying the ink mark; and a controller coupled to the dryer for controllably operating the dryer, so that the dryer selectively dries only the ink mark.

According to an aspect of the present invention, a printer having precision ink drying capability comprises a print head that is adapted to eject a plurality of ink drops through outlet orifices defined by the print head. The ink drops form a plurality of ink marks at a plurality of locations on a recording medium positioned opposite the outlet orifices in order to define a printed image on the recording media. A plurality of heaters is disposed near the print head and are distributed transversely across the width of the recording media for heating the ink marks on the recording media in order to dry the ink marks. Drying the ink marks fixes the ink to the recording media. A plurality of sensors, disposed near the print head are distributed transversely across the width of the recording media and are coupled to respective ones of the heaters for sensing the locations of the ink marks on the recording media. In addition, a controller interconnects each of the heaters to respective ones of the sensors for selectively energizing the heaters according to the locations of the ink marks sensed on the recording media by the sensors. Thus, the controller selectively informs the heaters of the locations of the ink marks on the recording media as the sensors sense the ink marks. In this manner, the heaters dry only the locations having ink marks. The heaters may be resistance heaters, microwave heaters or radiant heaters. The sensors may be thermocouples or optical sensors.

A feature of the present invention is the provision of a plurality of sensors adapted to sense presence of ink marks comprising the image printed on the recording media.

Another feature of the present invention is the provision of a plurality of heaters coupled to the sensors for heating only the ink marks sensed by the sensors.

An advantage of the present invention is that use of the present invention saves energy.

Another advantage of the present invention is that amount of heat applied to ink marks varies depending on the amount of ink thereat sensed by the sensors.

Still another advantage of the present invention is that speed of printing is increased.

Yet another advantage of the present invention is that scorching of the recording media is avoided.

A further advantage of the present invention is that use thereof avoids use of the large volumes of gas and large amounts of energy needed to heat the gas, as in blower-type ink drying systems.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

Figure 1:
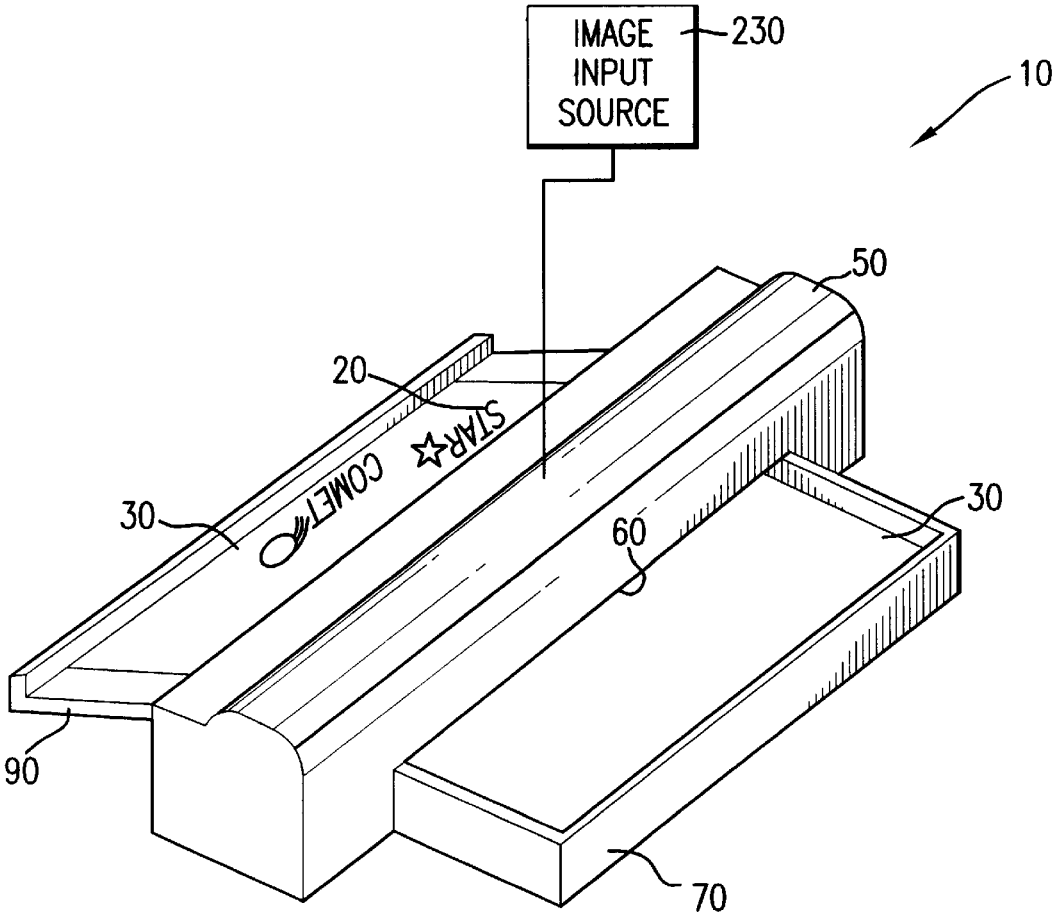
FIG. 1 is a perspective view of an inkjet printer according to the present invention.

The present invention will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3, 4 and 5 there is shown a thermal inkjet printer, generally referred to as 10, for printing an Image 20 on a recording media 30. Recording media 30 has top surface 33 and a bottom surface 35 and may be a reflective recording media (e.g., paper or fabric) or a transmissive recording media (e.g., polymer transparency) or other type of recording media suitable for receiving ink that forms image 20. As described more fully hereinbelow, image 20 is formed by a multiplicity of ink marks 40. Printer 10 comprises a housing 50 having an inlet opening 60 that receives a supply tray 70 having a stack sheet supply of the recording media therein. Housing also has an outlet opening 80 for egress of a finally printed sheet of recording media 30. In this regard, the finally printed sheet of recording media 30 will exit printer 10 and will be received by an output tray 90, so that the printed sheet of recording media 30 can be retrieved by an operator of printer 10.

Still referring to FIGS. 1, 2, 3, 4 and 5, disposed in housing 50 is a picker mechanism, generally referred to as 100, for picking individual sheets of recording media 30 from supply tray 70. In this regard, picker mechanism 100 comprises a motor 110 engaging an axle 120 for rotating axle 120 in a direction illustrated by arrow 125. Affixed to axle 120 is at least one roller 130 adapted to engage a topmost sheet of recording media 30 and transport that sheet of recording media 30 onto a guide ramp 140, for reasons disclosed presently. Moreover, picker mechanism 100 further comprises a biasing assembly, such as a spring 150, for biasing roller 130 into engagement with the top-most sheet of recording media 30 when required.

Referring again to FIGS. 1, 2, 3, 4 and 5, previously mentioned guide ramp 140 is interposed between supply tray 70 and a print head 160. In this regard, guide ramp 140 is aligned with print head 160 and supply tray 70. Print head 160 is preferably a stationary page-width print head comprising a plurality of ink modules 170*a*/*b*/*c*/*d*. Each ink module 170*a*/*b*/*c*/*d* has a plurality of ink ejection chambers 180 therein each holding a predetermined colored ink, such as yellow, magenta, cyan or black ink, respectively. In the preferred embodiment of the present invention, ink is supplied from an external "off-axis" ink supply (not shown). In addition, each ink module 170*a*/*b*/*c*/*d* defines a plurality of ink ejection chambers 180. Alternatively, each ink module 170*a*/*b*/*c*/*d* may contain its own "on-board" ink supply, if desired. Disposed in each ink ejection chamber 180 is a thin-film thermal resistor 190 for supplying heat to ink in ink ejection chamber 180. Moreover, in fluid communication with the ink in ink ejection chamber 180 is an outlet orifice 200 for exit of an ink drop 210 from print head 160, as described in more detail presently. In this regard, each ink ejection chamber 180 is formed opposite its respective outlet orifice 200 so ink can collect between the ink ejection chamber 180 and outlet orifice 200. Also, each thermal resistor 190 is connected to a controller 220 also disposed in housing 50. Controller 220 selectively supplies sequential electrical pulses to thermal resistors 190 for actuating thermal resistors 190. When controller 220 supplies the electrical pulses to thermal resistors 220, the thermal resistors heats a portion of the ink adjacent to thermal resistors, so that the portion of the ink adjacent thermal resistors 220 vaporizes and forms a vapor bubble (not shown). Formation of the vapor bubble pressurizes the ink in ink ejection chamber 180, so that ink drop 200 ejects out outlet orifice 200 to produce mark 40 on recording media 30 which is positioned opposite outlet orifice 200. Image input to controller 220 is by means of an input source 230 connected to controller 220. Image input source 230 may be a personal computer, scanner, facsimile machine, or the like.

Referring yet again to FIGS. 1, 2, 3, 4 and 5, picker mechanism 100 feeds a sheet of recording medium 30 from supply tray 70 and onto guide ramp 140, which guides the sheet of recording medium 30 into alignment opposite outlet orifices 200. A generally cylindrical combination support and transport member 240 is also disposed opposite print head 160 for supporting recording media 30 beneath print head 160 and for transporting recording media 30 past print head 160 in direction of arrow 243 as print head 160 ejects ink drops 210 onto recording media 30. In order to transport recording media past print head 160, combination support and transport member 240 is rotatable in the direction illustrated by an arrow 245 by a motor (not shown) disposed in housing 50.

Referring to FIGS. 2, 3, 4 and 5, disposed in housing 50 is a platform 250 located near print head 160 and aligned with combination support and transport member 240 for supporting a plurality of side-by-side heaters 260 thereon. Each heater 260, which is affixed to platform 250, may be a resistance heater, microwave heater or a radiant heater or any combination thereof In the case when heater 260 is a resistance heater, the heater 260 comprises a material, such as copper, or any other suitable material which rises in temperature when an electrical current is supplied to the material. In the case when heater 260 is a microwave heater, the heater 260 comprises a suitable microwave transmitter. Also, when heater 260 is a radiant heater, the heater 260 may include a tubular quartz infra-red lamp, a quartz tube heater, a metal rod heater or an ultraviolet heater. In order to suitably heat ink marks 40, the heat output from each heater 260 will be a function of recording media speed, type of recording media and the like. By way of example only, and not by way of limitation, heat output from each heater 260 may be between approximately zero watts/mm$^2$ and approximately 100 watts/mm$^2$.

Figure 5:
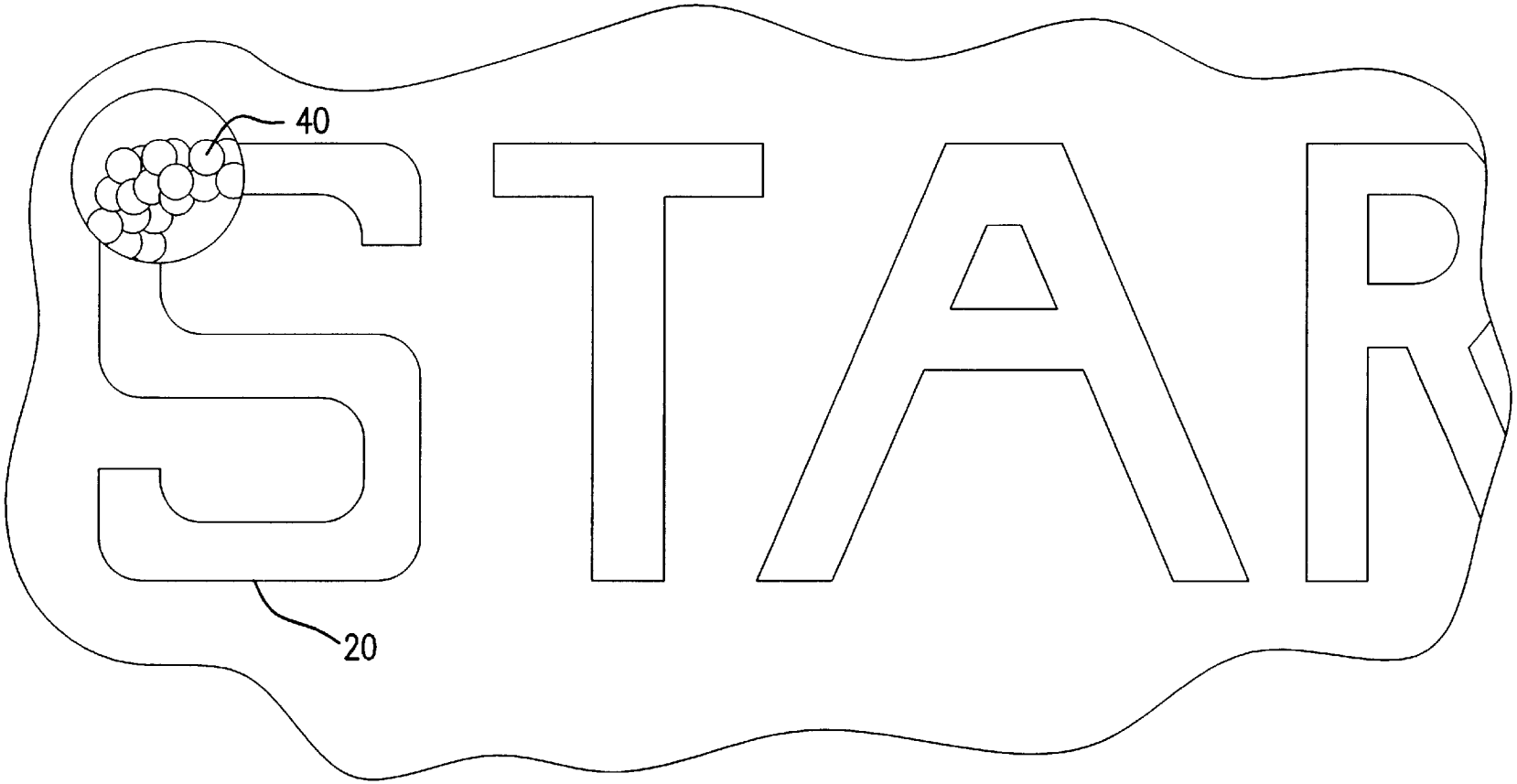
FIG. 5 is a fragmentary view of a recording having an image printed thereon comprising a multiplicity of ink marks.
Figure 6:
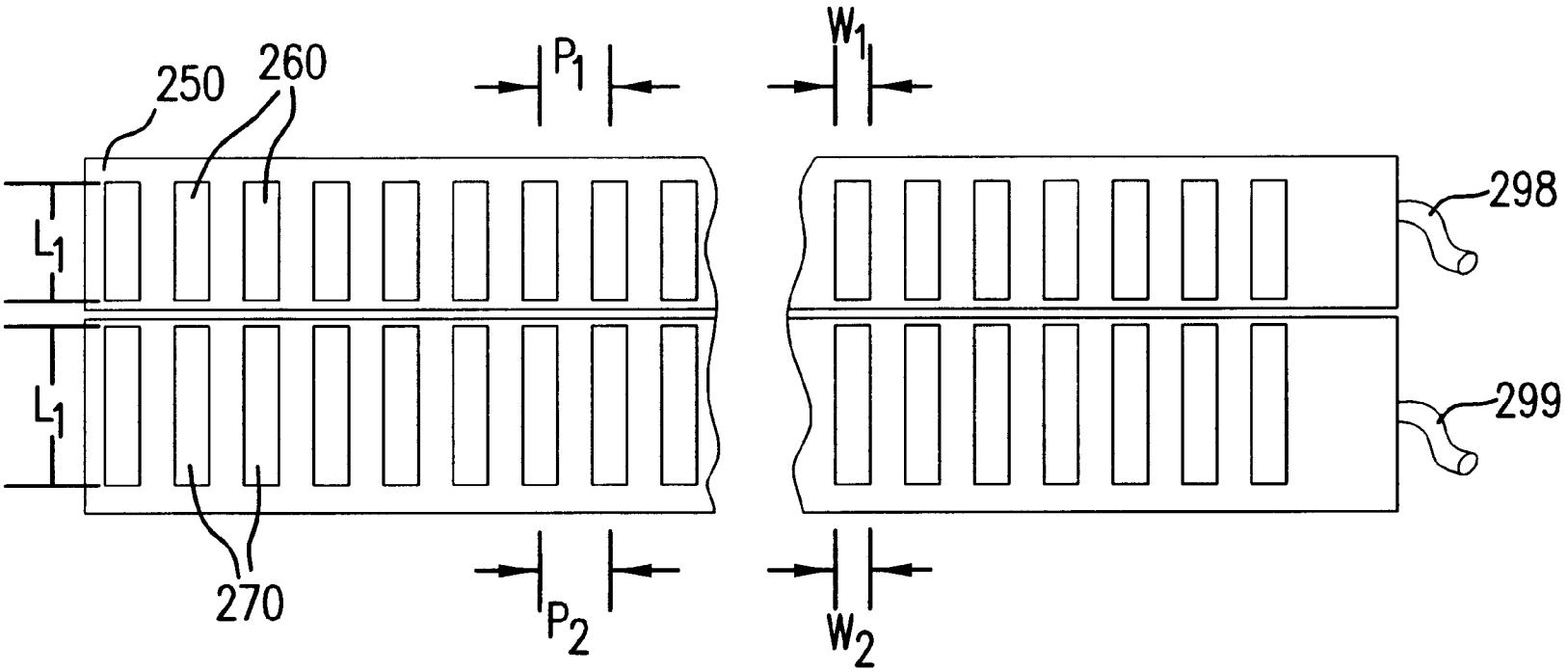
FIG. 6 is a view of a page-width platform having a plurality of heaters and sensors affixed thereto.

As best seen in FIGS. 5 and 6, side-by-side heaters 260 are spaced-apart and arranged parallel one-to-another in a row extending the length of print head 160. A length "$L_1$" and a width "$W_1$" of each heater 260 as well as a pitch "$P_1$" (i.e., spacing) between adjacent heaters 260 are preferably chosen so as to optimize fabrication cost and drying precision. In this manner, control of ink drying is precise and optimized. In the preferred embodiment of the invention, the length "$L_1$" is 0.125 inches (0.318 centimeters), the width "$W_1$" is 0.020 inches (0.051 centimeters) and the pitch "$P_1$"

is 0.050 inches (0.127 centimeters). However, it should be appreciated that the length "$L_1$", width "$W_1$" and pitch "$P_1$" are limited mainly by the ability to micro-fabricate heaters 260 and thereafter affix heaters 260 to platform 250. Moreover, each heater 260 is shown as having a rectangular transverse cross-section; however, each heater 260 may assume any convenient transverse cross-section or overall shape and all such alternative configuratiors of heaters 260 are contemplated within the breadth and scope of the present invention. In addition, there may a thermal insulator (not shown) interposed between adjacent heaters 260 to prevent thermal "cross-talk" between any adjacent heaters 260. Preventing thermal cross-talk between any adjacent heaters 260 more efficiently directs the heat directly to the intended ink marks 40. In this regard, the heater array may be fabricated in a thermally insulating substrate to minimize thermal "cross-talk".

Referring again to FIGS. 5 and 6, also affixed to platform 250 is a plurality of side-by-side sensors 270. Sensors 270 may be based on conventionally known technology or any suitable method for sensing temperature of recording medium 30. In addition, sensors 270 may be RTD's, thermocouples, or other devices for sensing moisture by means of electrical conductivity or other suitable method. As may be appreciated from the disclosure hereinabove, the location on recording media where an ink mark 40 is present has a different temperature (elevated temperature) than where ink mark 40 is absent. Sensor 270 advantageously senses those locations of elevated temperature to identify locations on recording media 30 having ink marks. Side-by-side sensors 270 are spaced-apart and arranged parallel one-to-another in a row extending the length of print head 160. A length "$L_2$" and a width "$W_2$" of each sensor 270 as well as a pitch "$P_2$" (i.e., spacing) between adjacent sensors 270 are preferably chosen so as to sense or detect as small a population of ink marks 40 as possible. In this manner, sensing of ink marks 40 is precise and optimized. In the preferred embodiment of the invention, the length "$L_2$" is 0.12 inch (0.3 centimeters), the width "$W_2$" is 0.04 inch (0.1 centimeters) and the pitch "$P_2$" is 0.050 inches (0.127 centimeters). However, it should be appreciated that the length "$L_2$", width "$W_2$" and pitch "$P_2$" are limited mainly by the ability to micro-fabricate sensors 270 and thereafter affix sensors 270 to platform 250. Moreover, each sensor 270 is shown as having a rectangular transverse cross-section; however, each sensor 270 may assume any convenient transverse cross-section or overall shape and all such alternative configurations of sensors 270 are contemplated within the breadth and scope of the present invention. In addition, the length $L_2$, width $W_2$ of each sensor 270 and pitch $P_2$ need not be equivalent to the length $L_1$, width $W_1$ and pitch $P_1$ of heaters 260.

Figure 2:
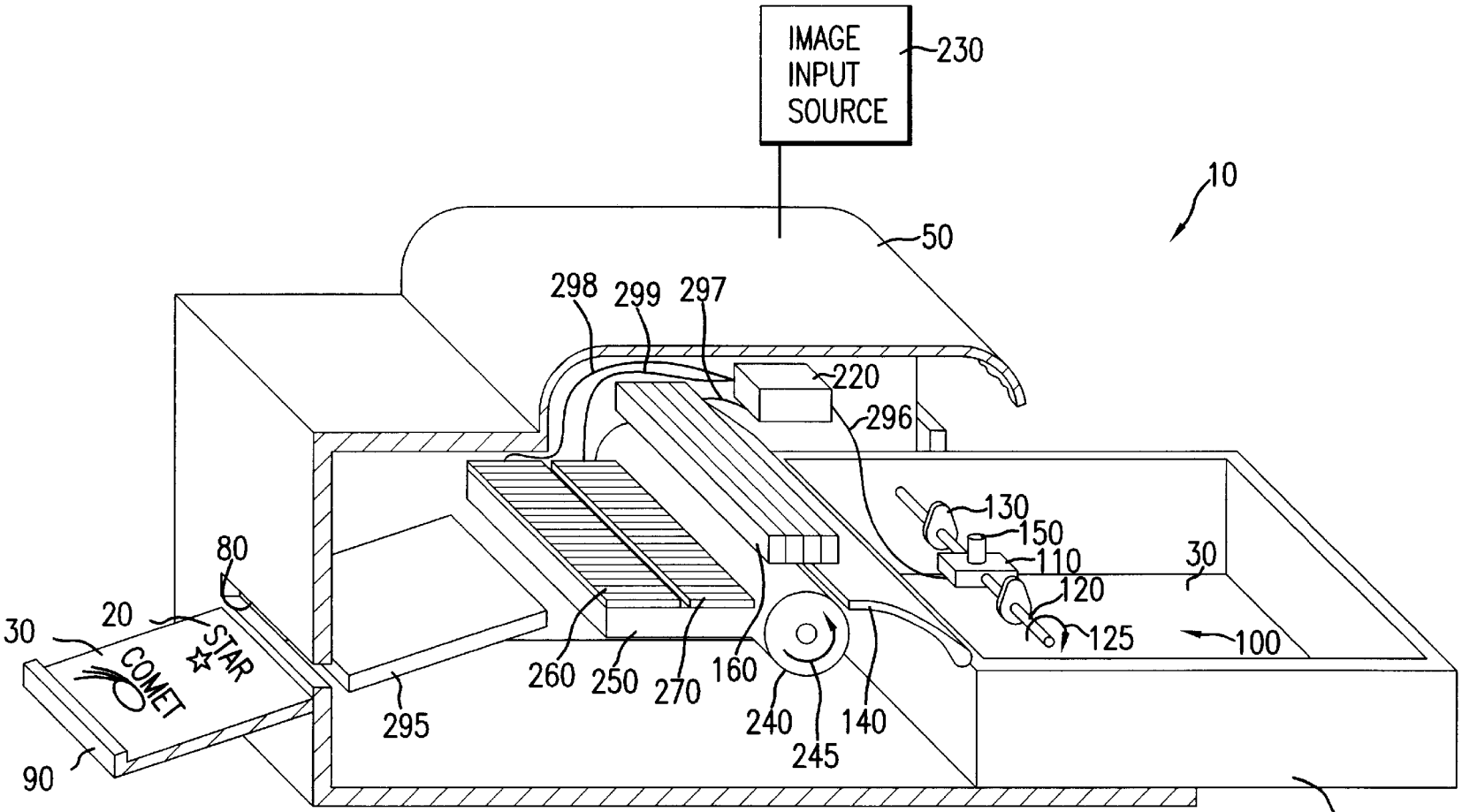
FIG. 2 is perspective view in partial vertical section of the printer.
Figure 3:
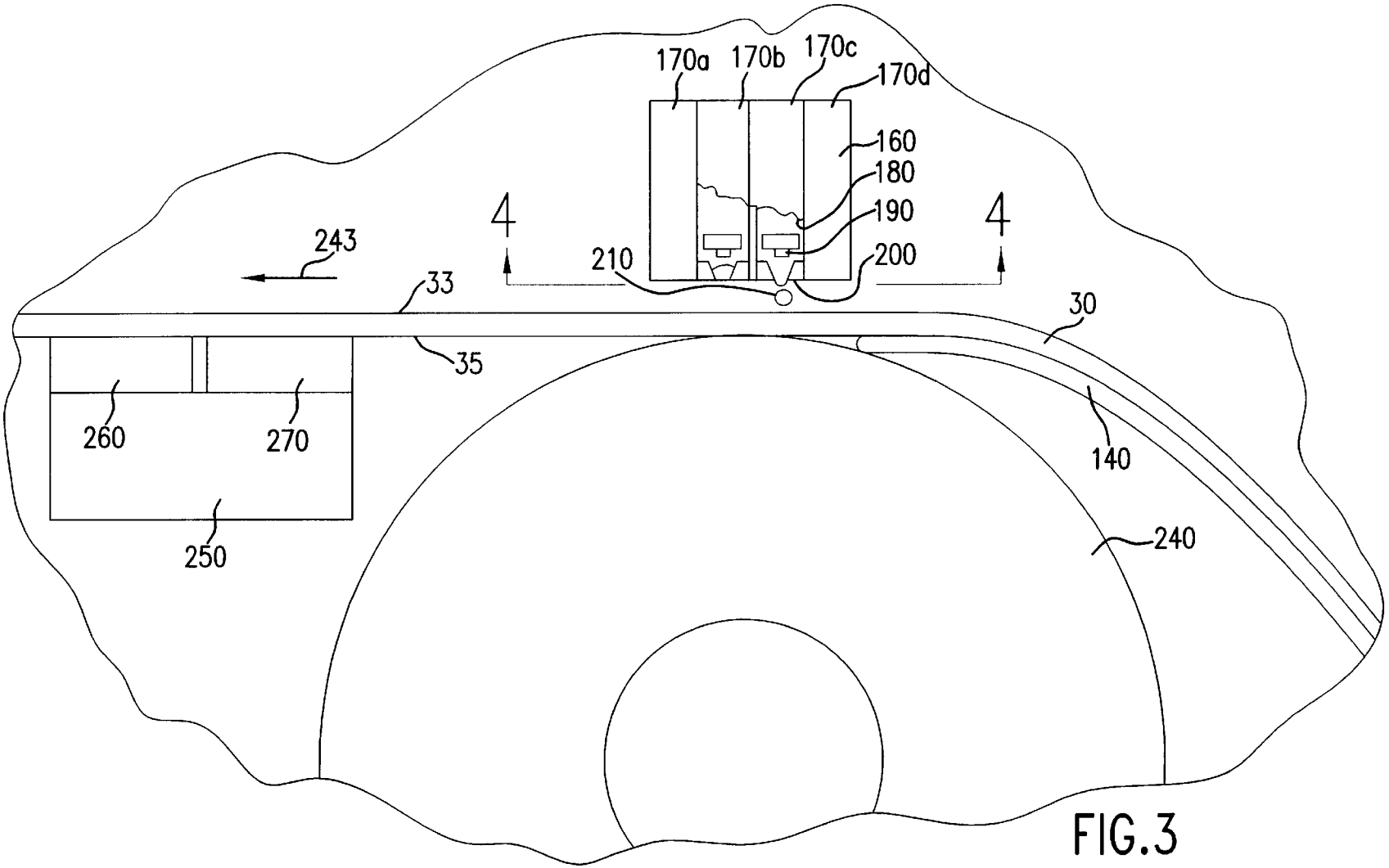
FIG. 3 is a fragmentary view of the printer, showing internal components belonging to the printer.
Figure 4:
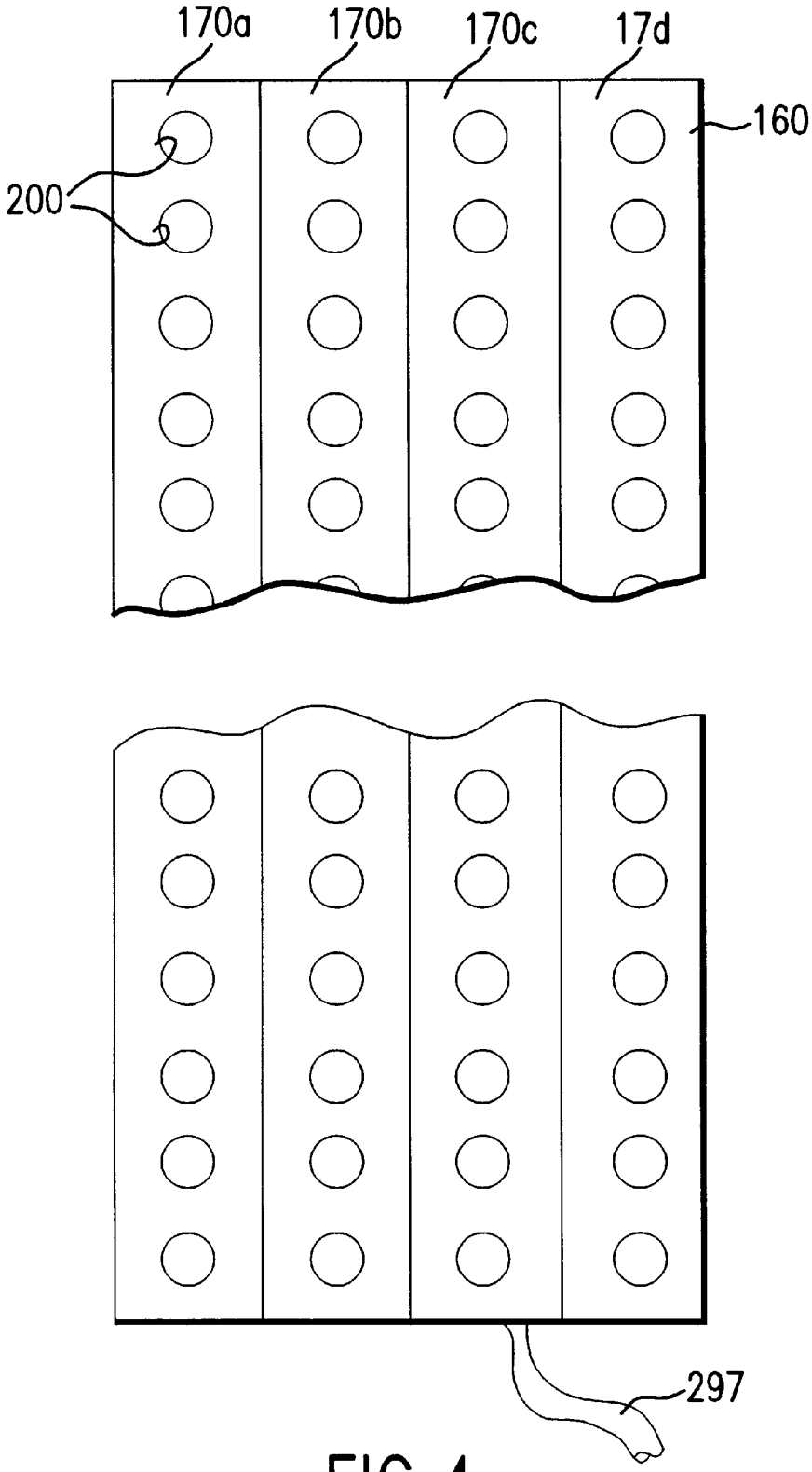
FIG. 4 is a view taken along section line 4—4 of FIG. 3.
Figure 7:
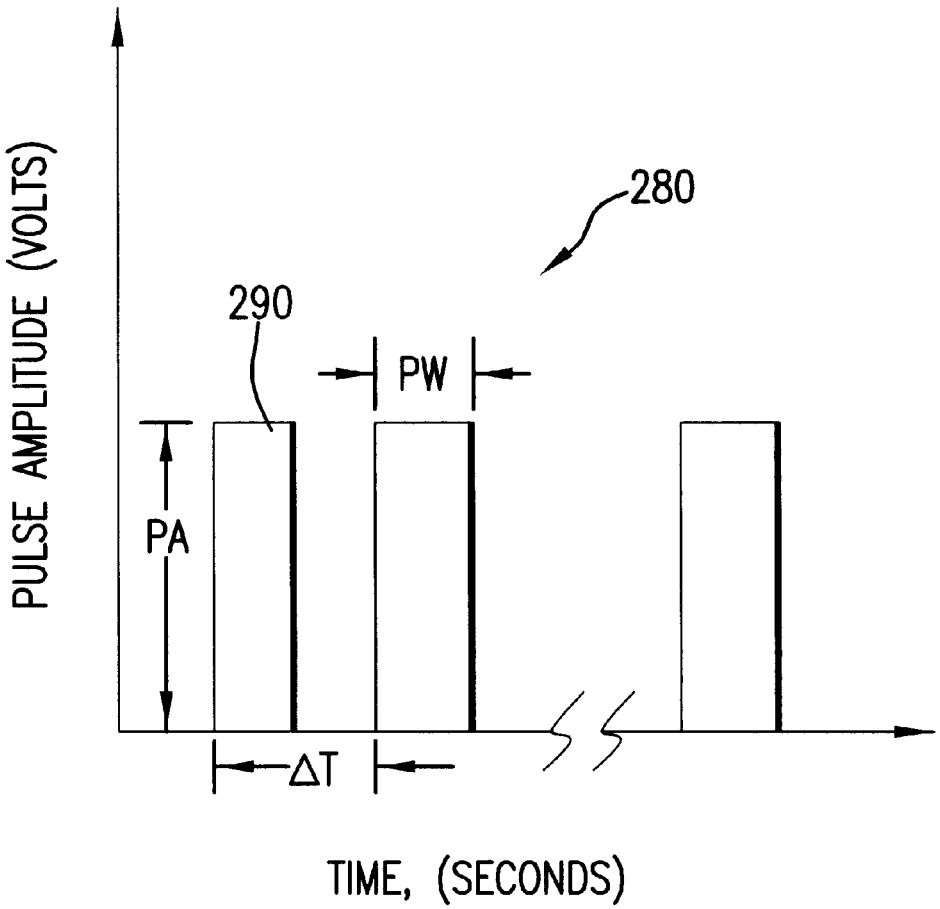
FIG. 7 is a graph illustrating an electrical pulse train comprising a plurality of electrical pulses.

Referring to FIGS. 2, 3 and 7, previously mentioned controller 220 is electrically connected to each thermal resistor 190 for electrically selectively actuating resistors 190. In this regard, controller 220 selectively supplies an electrical pulse train, generally referred to as 280, comprising a plurality of electrical pulses 290. Pulses 290 are selectively supplied to thermal resistors 190 according to electrical output signals received from image input source 230, which is electrically connected to controller 220. Pulses 290 are illustrated as square-shaped, however, pulses 290 may take any known shape, such as triangular-shaped or sinusoidally-shaped. Moreover, controller 220 controls pulse amplitude "PA", pulse width "PW" and time between pulses "$\Delta T$" in order to control volume of ink drop 210 ejected out outlet orifice 200. For example, each time controller 220 supplies a pulse 290 to thermal resistor 190, one ink drop 210 is ejected out outlet orifice 200. In addition, controller 220 is electrically connected to each sensor 270 for receiving output signals therefrom each time a sensor 270 senses presence of ink mark 40. Controller 220 in turn transmits the output signal received from sensors 270 to respective ones of heaters 260. In this manner, sensors 270 inform heaters 260 of the locations of ink marks 40 on recording media 30 for activating selected ones of heaters 260 in order to dry only those locations having ink marks 40. Platform 250 is disposed opposite bottom surface 35 of recording media 30, so that heaters 260 and sensors 270 that are affixed thereto come into contact with bottom surface 35. In this manner, heaters 260 transfer heat through recording media 30 to ink marks 40 by means of conduction through recording media 30. After ink marks 40 comprising image 20 are printed and dried, support and transport member 240 transports recording media 30 to a downwardly-canted slide 295 interposed between platform 250 and outlet opening 80. Printed recording media 30 is received by slide 295 and slides therealong until it passes through outlet opening 80 and lands in output tray 90 to be retrieved by the operator of printer 10. In addition, previously mentioned controller 220 is connected, such as by means of first electrical conducting wire 296, to motor 110 for controlling operation of motor 110. Controller 220 is also connected, such as by means of second electrical conducting wire 297, to print head 160 for controlling operation of print head 160. In addition, controller 220 is connected to heaters 260 and sensors 270, such as by means of third electrical conducting wire 298 and fourth electrical conducting wire 299, respectively, for controlling operation of heaters 260 and sensors 270. Moreover, controller 220 is connected, such as by means of a fifth electrical conducting wire (not shown), to a motor (also not shown) for rotating support and transport member 240 in the direction of arrow 245.

Figure 8:
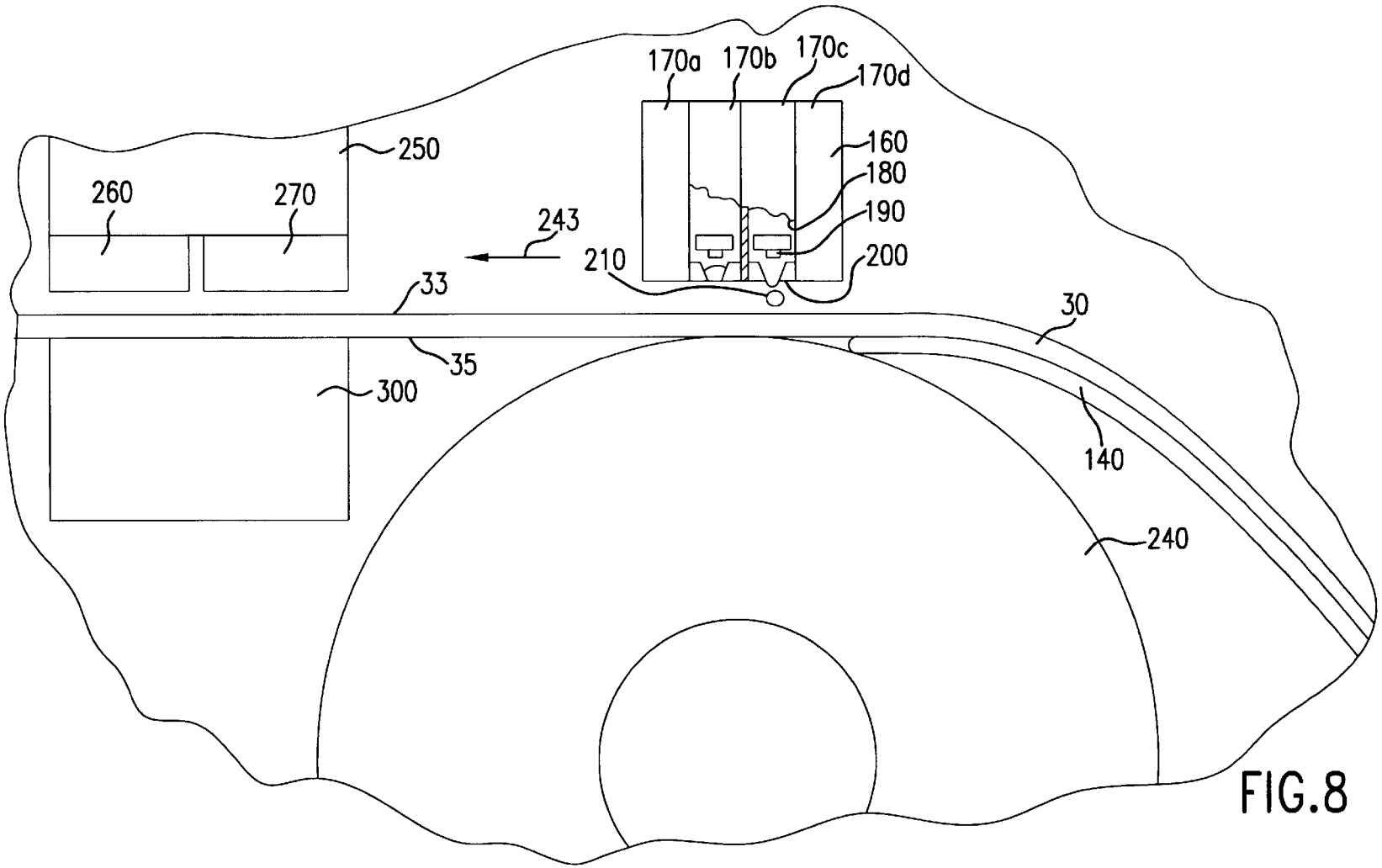
FIG. 8 is a fragmentary view of a second embodiment printer of the present invention, showing internal components belonging to the second embodiment printer.

Referring to FIG. 8, there is shown a second embodiment of the present invention. According to this second embodiment of the present invention, heaters 260 and sensors 270 are disposed opposite top surface 33 of recording medium 30. In this second embodiment, heaters 260 and sensors 270 are spaced-apart from recording medium 30 by a predetermined distance, rather than being in contact with recording media 30, so as to avoid smearing ink marks 40 as recording media 30 is transported past print head 160. In this manner, heat is transferred to ink marks 40 by means of radiation. Also, according to this second embodiment of the present invention, a base 300 contacting bottom surface 35 of recording media 30 is provided to support recording media 30 as recording media 30 travels past heaters 260 and sensors 270. An advantage of this second embodiment of the present invention, is that risk of scorching of recording media 30 is reduced because heaters 260 do not come into contact with recording media 30.

Figure 9:
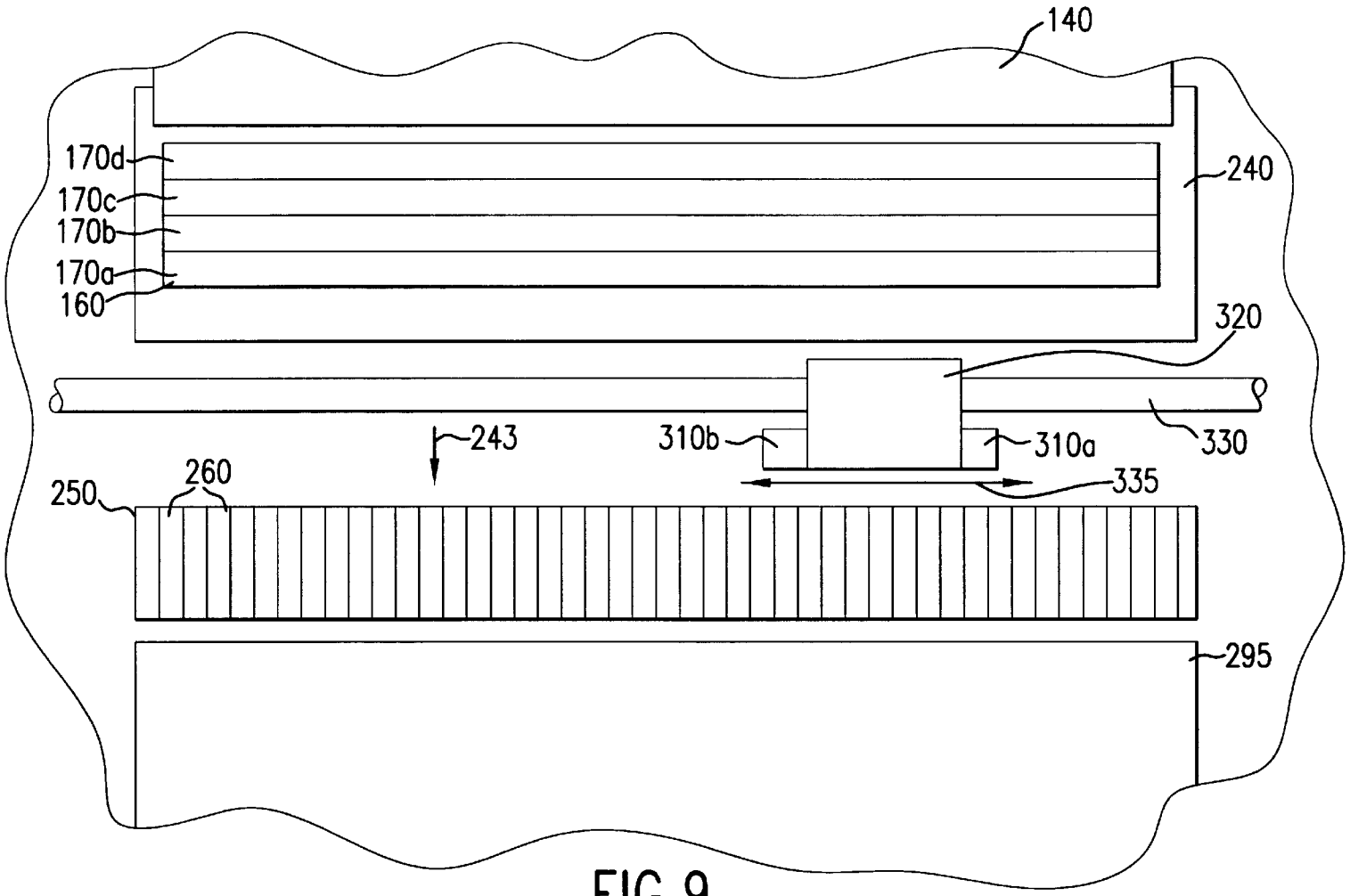
FIG. 9 is a fragmentary view of a third embodiment printer of the present invention, showing a pair of sensors mounted on a reciprocating carriage.

Referring to FIG. 9, there is shown a third embodiment of the present invention. According to this third embodiment of the present invention, a pair of sensors **310*a* and 310*b* disposed opposite top surface 33 of recording media 30 are connected to a carriage 320 that is slidably movable along an elongate rail 330 extending the width of recording media 30 and parallel to print head 160. In this regard, carriage is adapted for reciprocating movement along rail 330 by means of a motor (not shown) coupled to carriage 320. Carriage 320 moves along rail 330 transversely with respect to recording media in the direction of double-headed arrow 335. Preferably, as carriage 320 moves in one direction transversely with respect to recording media 30, sensor 310*a*** will sense any ink marks in its path and as carriage 320 moves in the other direction transversely with respect to recording media 30, sensor 310*b* will sense other ink marks in its path. An advantage of this third embodiment of the present invention is that fewer sensors are required for increased cost savings.

Figure 10:
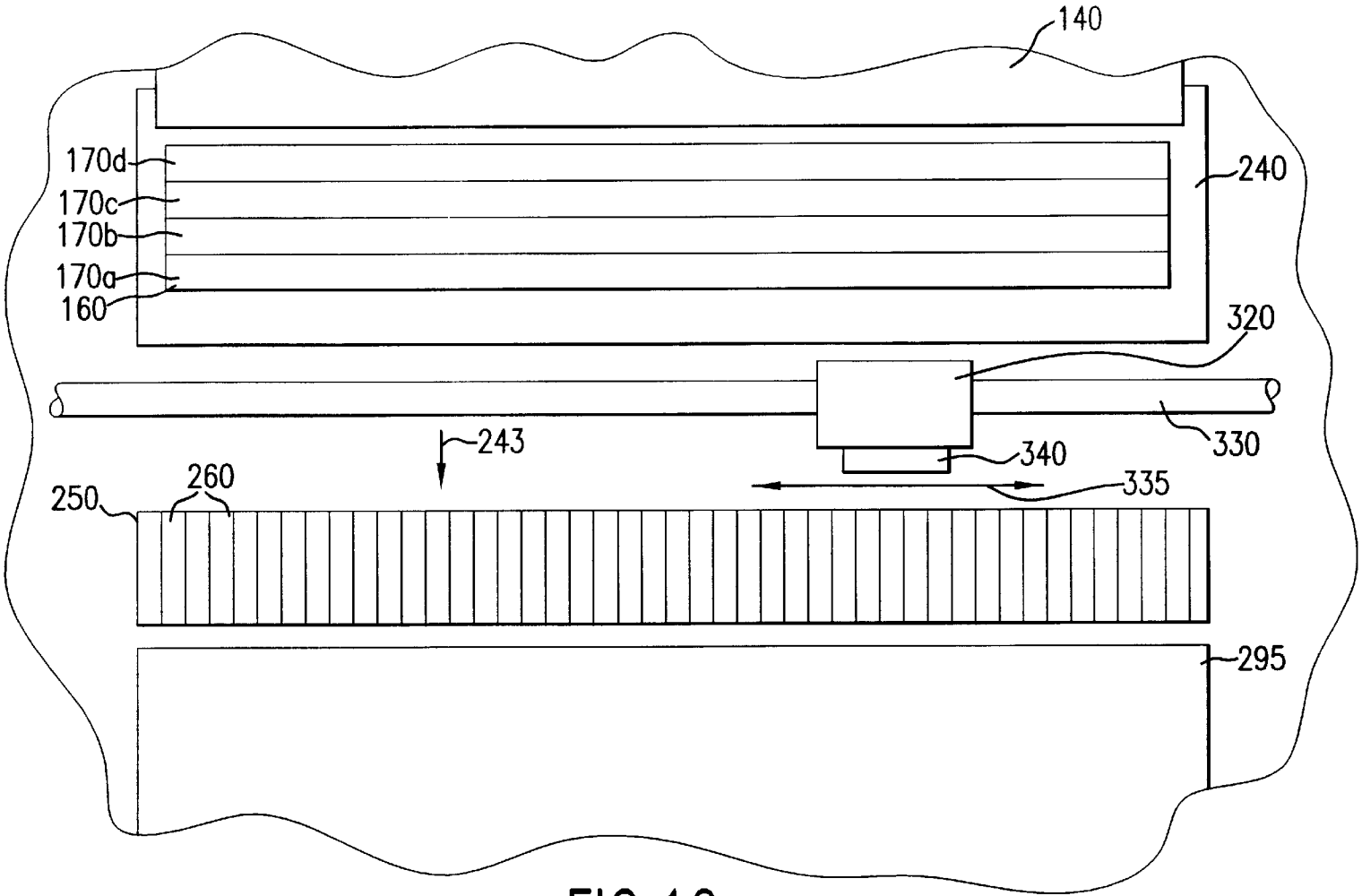
FIG. 10 is a fragmentary view of a fourth embodiment printer of the present invention, showing a single sensor mounted on the reciprocating carriage.

Referring to FIG. 10, there is shown a fourth embodiment of the present invention. This fourth embodiment of the present invention is substantially similar to the third embodiment of the present invention, except that the pair of sensors 310*a/b* is replaced by a single sensor 340 connected to carriage 320. Single sensor 320 senses ink marks 40 each time reciprocating carriage 320 traverses recording media 30. An advantage of this fourth embodiment of the present invention is that number of sensors is reduced even further as compared to the third embodiment of the present invention for even greater cost savings.

Figure 11:
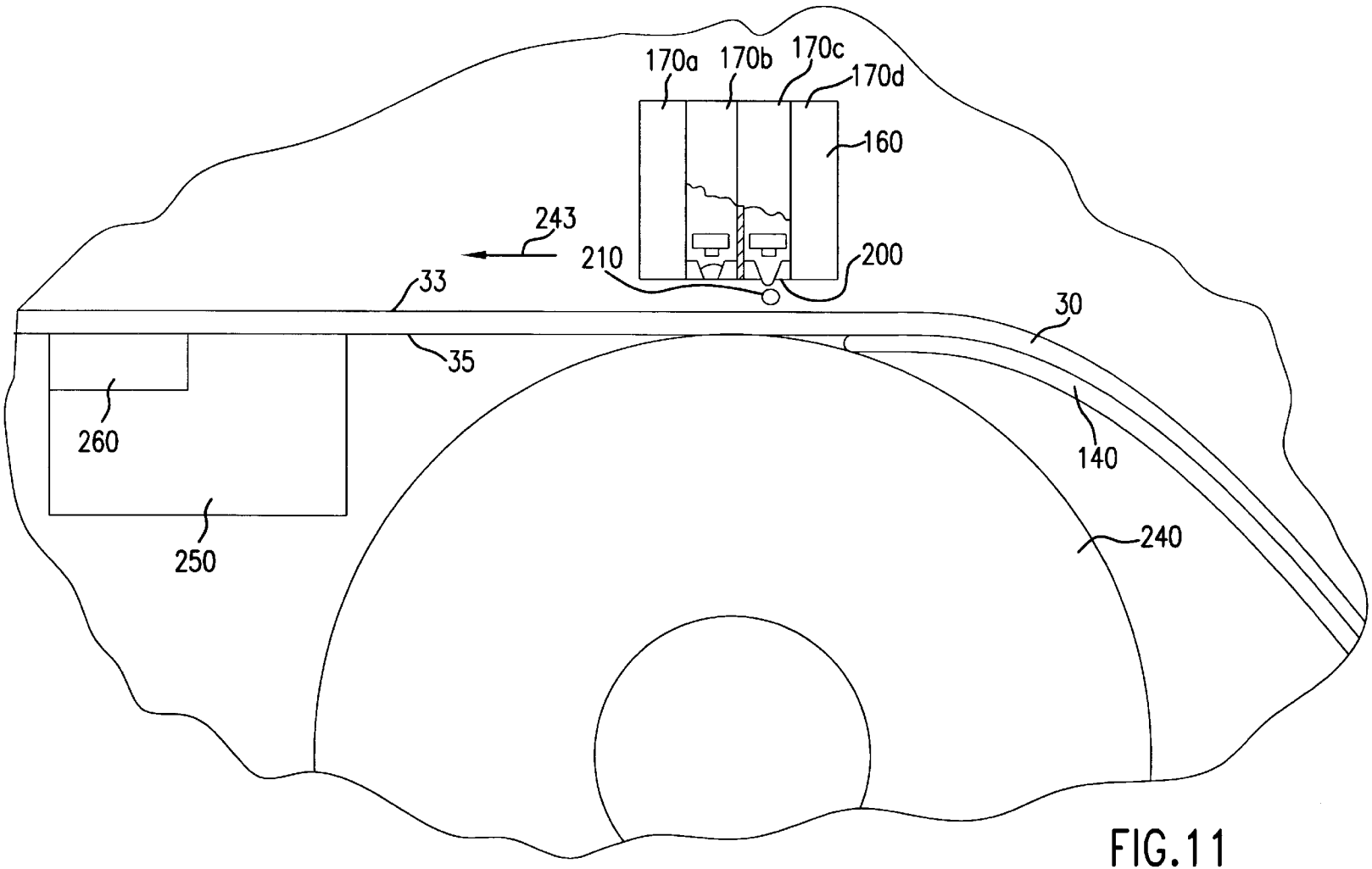
FIG. 11 is a fragmentary view of a fifth embodiment printer of the present invention, wherein the sensors are absent.

Referring to FIG. 11, there is shown a fifth embodiment of the present invention. This fifth embodiment of the present invention is substantially similar to the first embodiment of the present invention, except that sensors 270 are absent. Rather, electrical pulses 290 that are transmitted to thermal resistors 190 are also transmitted to respective ones of heaters 260 for informing heaters 260 of which thermal resistors 190 have been actuated. In this manner, heaters 260 will heat only those locations of recording media 30 having ink marks formed by the actuation of respective ones of thermal resistors 190.

Figure 12:
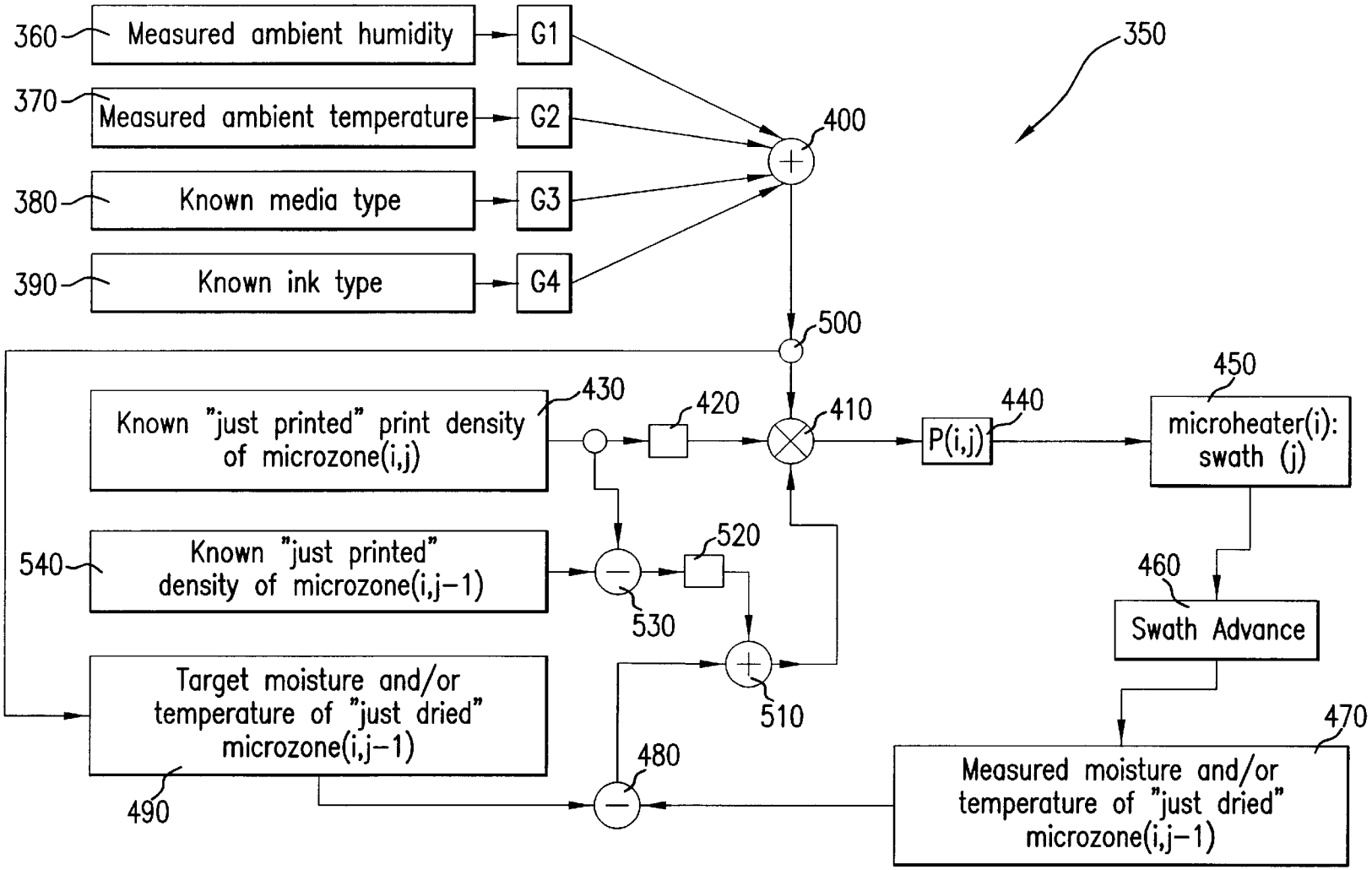
FIG. 12 is a flow chart illustrating an algorithm for controlling operation of the heaters and sensors.

Referring to FIG. 12, a control algorithm, generally referred to as 350, may be present in controller 220 for controlling heaters 260, based on inputs from sensors 270, information about local print density, and other global parameters. In this regard, control algorithm 350 comprises sensor 270 in printer 10 that measures ambient humidity, as illustrated by block 360. Similarly there is another sensor 270 in printer 10 that measures the ambient temperature, as illustrated by block 370. Printer is also provided with information about recording media type, as illustrated by block 380, and the ink type, as illustrated by block 390. These global values for recording media type and ink type are input into their respective transfer functions. In other words, ambient humidity is input into transfer function G1. In addition, ambient temperature is input into transfer function G2, also media type is input into transfer function G3. Finally, ink type is input into transfer function G4. The outputs of the transfer functions G1 through G4 are summed at the summing junction 400.

Referring again to FIG. 12, the output of junction 400 is fed into the summing junction 410. Thus, the first of three inputs into summing junction 410 is the output of junction 400. The second of three inputs into the summing junction 410 is the output of a transfer function 420 which operates on known information about what was just printed in each of printed microzones (i, j) on recording media 30, as illustrated by block 430. The third input into summing junction 410 is described below.

Still referring to FIG. 12, the output from junction 410 is fed into a power transfer function 440. The output of power transfer function 440 is amplified in order to drive the microheaters 260, for each microheater i and each swath j, as illustrated by block 450. It may be appreciated by a person of ordinary skill in the art, that each heater (i) could be composed of a plurality of separately controllable subheaters i1, i2, i3, and so forth. For the purposes of the embodiment disclosed herein, each heater (i) is a unitary or single unit.

Referring again to FIG. 12, as a result of the power output from the microheaters 260, and after the next swath advance, as shown at block 460, the swath (j−1) will have a resultant moisture and temperature to be measured in each measurement microzone (i, j−1) on recording media 30, as illustrated by block 470. The output of block 470 is fed into the difference junction 480. In addition, the output of a target moisture/temperature block 490 is fed into difference junction 480. Target block 490 is a function of the information pulled out of the control loop at node 500. In addition, the parameters of target block 490 may include user-supplied settings, or other printing parameters.

Referring yet again to FIG. 12, the output of difference junction 480 is fed into the summing junction 510. In addition, the output of transfer function 520 is fed into summing junction 510. The transfer function 520 receives information from the difference junction 530, which compensates for differences in print density between the current swath density at block 430 and the previous swath density at block 540. The output of the summing junction 510 is fed into the summing junction 410, and as such is the third input into the summing junction 410. Moreover, it should be noted that algorithm 350 can be generalized to include regions of more than one increment away from the critical zones (i, j) in order to take into account the spreading of moisture and heat from the microzone in question. For example, algorithm 350 can incorporate additional feedback from the regions bounded by zones (i, j−2), (i, j−3), and so forth, or (i+1, j−1), (i−1, j−1), and so forth, as determined to be useful.

With reference to FIG. 12, what is enabled, in summary, is a precision media drying system that applies the optimal energy in each printed area of the media (i.e., microzones i,j). The drying system adapts to changes in environmental conditions (e.g., moisture and temperature). In addition, the system learns to compensate for errors and variations in controlling moisture and temperature on a precision basis across the width of recording media 30.

Figure 13:
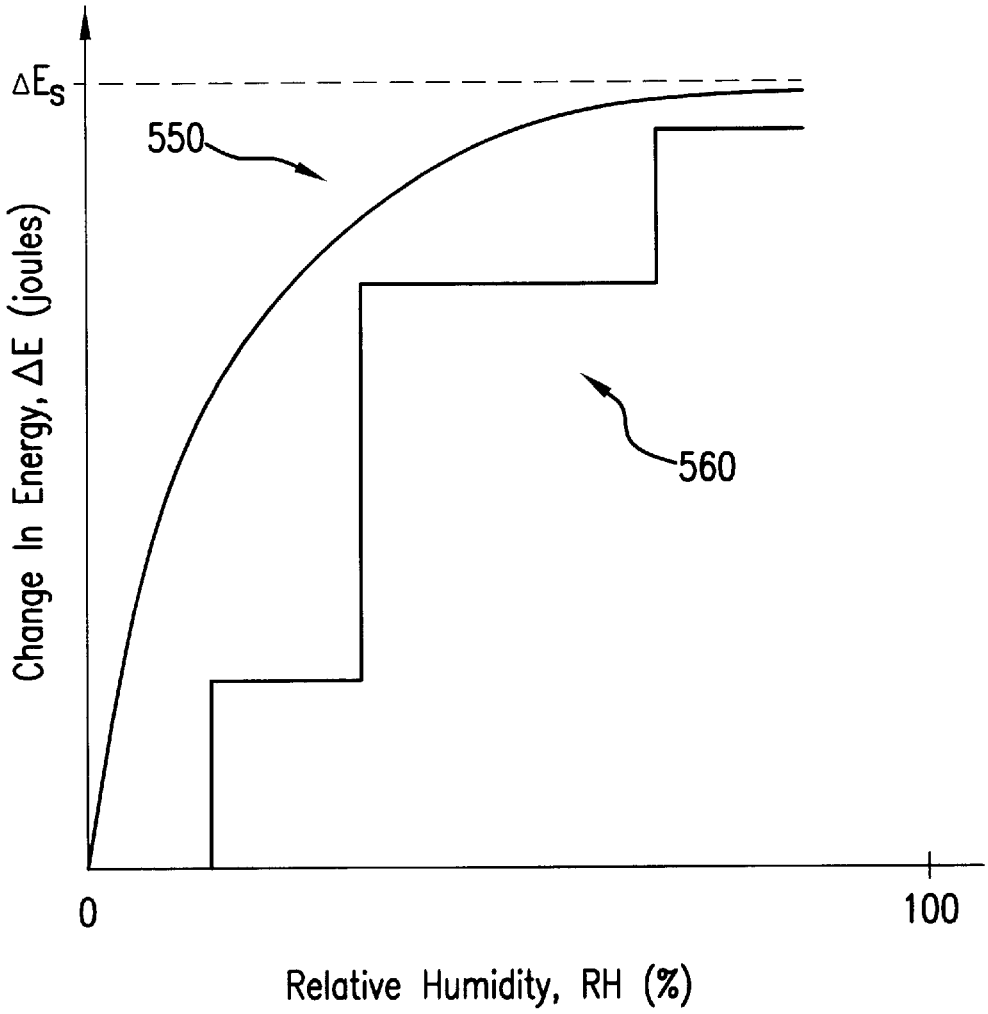
FIG. 13 presents a calibration curve used to control heat input to the ink marks according to ambient relative humidity.

Turning now to FIGS. 12 and 13, there is shown a representative first calibration curve 450 illustrating change in energy AE as a function of ambient relative humidity "RH". Such a first calibration curve 550 may be stored in controller 220. It is known that relative humidity is a function of both temperature and humidity. Therefore, sensors 270 may not only sense presence of ink marks 40, but also detect ambient temperature and humidity and transmit those values to controller 220. Controller 20 may then calculate relative humidity and use that value of relative humidity and first calibration curve 550 to determine the amount of energy to add to ink marks 40 in order dry ink marks 40 in view of the existing ambient relative humidity "RH". Of course, there may be a family of first curves 550 depending on the type of recording media being printed. It may be appreciated that, in general, one would expect "diminishing returns" on applied energy ΔE versus evaporation rate a function of RH. In other words, more energy would have to be pumped in for a given change in RH, as the RH increases, for a given desired end moisture level in the media. Curve 550 represents this relationship of "diminishing returns", and could also represent the calibration curve implemented in the present invention. An alternative to first calibration curve 550 is a second calibration curve 560. Second calibration curve 560 represents another type of implementation where the curve 560 is broken into segments, and the additional energy applied ΔE is constant over a given range or RH. This in general may b e more cost effective to implement than first calibration curve 550. A value $\Delta E_s$ represents a maximum or allowable level of applied energy ΔE in order to avoid damage (e.g., paper scorching hazard) to printer 10. It is noted that ambient RH is just one factor in the control loop represented by blocks 360 and 370 of FIG. 12.

It may be appreciated from the description hereinabove that an advantage of the present invention is that use of the present invention saves energy. This is so because heat is applied only to those locations on recording media 30 having ink marks 40 rather than to locations of recording media 30 not having ink marks 40 as well as those locations having ink marks 40.

Another advantage of the present invention is that amount of heat applied to ink marks 40 varies depending on the amount of ink thereat sensed by sensors 270. This is accomplished by varying the pulse amplitude "PA", pulse width "PW" and time "ΔT" between electrical pulses 290 supplied to heaters 260. That is, operation of heaters 260 can be individually modulated by controller 220 for more precise drying of ink marks 40.

Still another advantage of the present invention is that speed of printing is increased. This is so because speed of recording media past print head 160 can increase for a given print density, such as when sensors 270 sense no or few ink marks 40 present in a print line.

Yet another advantage of the present invention is that scorching of recording media 30 is avoided. This is so because only those locations on recording media 30 having ink marks 40 are heated. Locations not having ink marks 40 or fewer ink marks 40 are not heated, thereby reducing risk of scorching.

A further advantage of the present invention is that use thereof avoids use of the large volumes of gas and large amounts of energy needed to heat the gas, as in blower-type ink drying systems. This is so because the ink marks are dried by use of conductive, microwave or radiant heating rather than heated gas blown onto ink marks 40.

While the invention has been described with particular reference to its preferred embodiments, it will be understood by those skilled in the art that various changes may be made and equivalents may be substituted for elements of the preferred embodiments without departing from the invention. For example, print head 160 need not be a page-width print head. Rather, print head 160 may be reciprocating-type print head adapted for reciprocating movement transversely across width of recording media 30. In this case, pair of sensors 310*a*/*b* or single sensor 340 may be connected to the reciprocating print head. As a further example, each individual sensor 270, 310*a*/*b* and 340 may communicate its sensing information by means of radio transmission to be received by a radio receiver connected to each of heaters 260. In this case, when each sensor transmits its radio signal of a predetermined frequency indicative of location and volume of ink at ink marks 40, respective heaters 260 receive the radio signals and are energized to variably heat the ink marks 40. As a further example, a piezoelectric print head rather than a thermal inkjet print head 160 may be used, if desired. As an additional example, it may be appreciated by a person of ordinary skill in the art that the inventive concept disclosed herein is not confined to printing mechanisms, but is also useable in any web feeding application where fluids are being applied and it is desired to dry or cure the fluid at an accelerated rate. Such applications of the inventive concept would be in manufacturing of paper, fabrics, adhesives, and the like.

Therefore, what is provided is a printer having precision ink drying capability and method of assembling the printer.

PARTS LIST $\Delta E_s$. . . maximum allowed change in energy
G1 . . . transfer function
G2 . . . transfer function
G3 . . . transfer function
G4 . . . transfer function
L . . . length of heater
P . . . pitch of heaters
PA . . . pulse amplitude
PW . . . pulse width
ΔT . . . time between pulses
W . . . width of each heater
10 . . . printer
20 . . . image
30 . . . recording media
33 . . . top surface of recording media
35 . . . bottom surface of recording media
40 . . . ink marks
50 . . . housing
60 . . . inlet opening
70 . . . supply tray
80 . . . outlet opening
90 . . . output tray
100 . . . picker mechanism
110 . . . motor
120 . . . axle
130 . . . roller
140 . . . guide ramp
150 . . . spring
160 . . . print head
170*a*/*b*/*c*/*d* . . . ink modules
180 . . . ink ejection chamber
190 . . . thermal resistor
200 . . . outlet orifice
210 . . . ink drop
220 . . . controller
230 . . . image input source
240 . . . support and transport member
243 . . . arrow
245 . . . arrow
250 . . . platform
260 . . . heaters
270 . . . sensors
280 . . . pulse train
290 . . . electrical pulses
295 . . . slide
296 . . . first conducting wire
297 . . . second conducting wire
298 . . . third conducting wire
299 . . . fourth conducting wire
300 . . . base
310*a*/*b* . . . pair of sensors
320 . . . carriage
330 . . . rail
335 . . . arrow
340 . . . single sensor
350 . . . control algorithm
360 . . . measured ambient humidity block
370 . . . measured ambient temperature block
380 . . . recording media type information
390 . . . known ink type information
400 . . . summing junction
410 . . . summingjunction
420 . . . transferjunction
430 . . . known "just printed" swath density of microzone (i,j
440 . . . power transfer function
450 . . . heaters are driven for each heater (i) and swath (j)
460 . . . swath advance
470 . . . measured moisture or temperature
480 . . . difference junction

490 . . . target moisture/temperature
500 . . . node
510 . . . summingjunction
520 . . . transfer function
530 . . . difference junction
540 . . . previous swath density
550 . . . first calibration curve
560 . . . second calibration curve

What is claimed is:

1. A printer having precision ink drying capability, comprising:

a. a print head adapted to form an ink mark at a location on a recording media;

b. a dryer associated with said print head for drying the ink mark; and c. a controller coupled to said dryer for controllably operating said dryer, so that said dryer selectively dries only the ink mark.

2. The printer of claim 1, further comprising a sensor associated with said dryer for sensing the location of the ink mark on the recording media.

3. The printer of claim 2, wherein said sensor is adapted to move transversely with respect to said recording media.

4. The printer of claim 2, wherein said controller is coupled to said sensor for informing said dryer of the location of the ink mark on the recording media as said sensor senses the ink mark.

5. The printer of claim 1, wherein said controller is coupled to said print head for informing said dryer of the location of the ink mark on the recording media as said print head forms the ink mark.

6. The printer of claim 1, wherein said dryer comprises a resistance heater.

7. The printer of claim 1, wherein said dryer comprises a microwave heater.

8. The printer of claim 1, wherein said dryer comprises a radiant heater.

9. A printer having precision ink drying capability, comprising:

a. a print head adapted to eject a plurality of ink drops for forming a plurality of ink marks at a plurality of locations on a recording medium;

b. a plurality of heaters disposed near said print head for heating the ink marks to dry the ink marks; and c. a controller connected to each of said heaters for selectively energizing said heaters according to the locations of the ink marks on the recording media, so that said heaters dry only the locations having ink marks.

10. The printer of claim 9, further comprising a sensor adapted to reciprocate transversely with respect to said recording media for sensing the locations of the ink marks on the recording media, said sensor being coupled to said heaters.

11. The printer of claim 9, further comprising a plurality of sensors coupled to respective ones of said heaters for sensing the locations of the ink marks on the recording media.

12. The printer of claim 11, wherein said controller is connected to each of said sensors for selectively informing said heaters of the locations of the ink marks on the recording media as said sensors sense the ink marks.

13. The printer of claim 9, wherein said controller is connected to said print head for informing said heaters of the locations of the ink marks on the recording media as said print head forms the ink marks on the recording media.

14. The printer of claim 9, wherein each of said heaters is a resistance heater.

15. The printer of claim 9, wherein each of said heaters is a microwave heater.

16. The printer of claim 9, wherein each of said heaters is a radiant heater.

17. A printer having precision ink drying capability, comprising:

a. a print head defining a plurality of ink ejection chambers therein, each ink ejection chamber adapted to eject a plurality of ink drops therefrom for forming a plurality of ink marks at a plurality of locations on a recording media;

b. a plurality of spaced-apart, parallel heaters aligned in a row transversely with respect to the recording media for heating the ink marks to dry the ink marks; and c. a controller electrically connected to each of said heaters for generating a plurality of electrical pulses selectively energizing said heaters according to the locations of the ink marks on the recording media, so that said heaters dry only the locations having ink marks.

18. The printer of claim 17, further comprising:

a. an elongate bar disposed near said heaters and extending transversely with respect to the recording media; and b. a sensor slidably engaging said bar and adapted to slidably reciprocate along said bar transversely with respect to the recording media for generating an electrical pulse upon sensing each of the locations of the ink marks on the recording media, said sensor being coupled to each of said heaters for transmitting the electrical pulses to said heaters corresponding to the locations of the ink marks.

19. The printer of claim 17, further comprising a plurality of sensors electrically connected to respective ones of said heaters for generating a plurality of electrical pulses upon sensing the locations of the ink marks on the recording media.

20. The printer of claim 19, wherein said controller is electrically connected to each of said sensors for receiving the electrical pulses generated by said sensors and for transmitting the electrical pulses to respective ones of said heaters for informing said heaters of the locations of the ink marks on the recording media as said sensors sense the ink marks.

21. The printer of claim 17, wherein said controller is electrically connected to each of said ink ejecting chambers for generating a plurality of electrical pulses for selectively electrically energizing said ink ejection chambers and for electively informing said heaters of the ink ejection chambers electrically energized, so that said heaters are informed of the locations of the ink marks on the recording media as said ink ejection chambers form the ink marks.

22. The printer of claim 17, wherein each of said heaters is a thermal resistance heater.

23. The printer of claim 17, wherein each of said heaters is a microwave heater.

24. The printer of claim 17, wherein each of said heaters is an infra-red radiant heater.

25. A method of assembling a printer having precision ink drying capability, comprising the steps of:

a. providing a print head adapted to form an ink mark at a location on a recording media;

b. coupling a dryer associated to the print head for drying the ink mark; and c. coupling a controller to the dryer for controllably operating the dryer, so that the dryer selectively dries only the ink mark.

26. The method of claim 25, further comprising the step of coupling a sensor to the dryer for sensing the location of the ink mark on the recording media.

27. The method of claim 26, further comprising the step of adapting the sensor to move transversely with respect to the recording media.

28. The method of claim 26, further comprising the step of coupling the controller to the sensor for informing the dryer of the location of the ink mark on the recording media as the sensor senses the ink mark.

29. The method of claim 25, further comprising the step of coupling the controller to the print head for informing the dryer of the location of the ink mark on the recording media as the print head forms the ink mark.

30. The method of claim 25, wherein the step of coupling the dryer comprises the step of coupling a resistance heater.

31. The method of claim 25, wherein the step of coupling the dryer comprises the step of coupling a microwave heater.

32. The method of claim 25, wherein the step of coupling the dryer comprises the step of coupling a radiant heater.

33. A method of assembling a printer having precision ink drying capability, comprising the steps of:

a. providing a print head adapted to eject a plurality of ink drops for forming a plurality of ink marks at a plurality of locations on a recording medium;

b. disposing a plurality of heaters near the print head for heating the ink marks to dry the ink marks; and c. connecting a controller to each of the heaters for selectively energizing the heaters according to the locations of the ink marks on the recording media, so that the heaters dry only the locations having ink marks.

34. The method of claim 33, further comprising the step of adapting a sensor to reciprocate transversely with respect to the recording media for sensing the locations of the ink marks on the recording media, the sensor being coupled to the heaters.

35. The method of claim 33, further comprising the step of coupling a plurality of sensors to respective ones of the heaters for sensing the locations of the ink marks on the recording media.

36. The method of claim 35, further comprising the step of connecting the controller to each of the sensors for selectively informing the heaters of the locations of the ink marks on the recording media as the sensors sense the ink marks.

37. The method of claim 33, further comprising the step of connecting the controller to the print head for informing the heaters of the locations of the ink marks on the recording media as the print head forms the ink marks on the recording media.

38. The method of claim 33, wherein the step of disposing the plurality of heaters comprises the step of disposing a plurality of resistance heaters.

39. The method of claim 33, wherein the step of disposing the plurality of heaters comprises the step of disposing a plurality of microwave heaters.

40. The method of clam 33, wherein the step of disposing the plurality of heaters comprises the step of disposing a plurality of radiant heaters.

41. A method of assembling a printer having precision ink drying capability, comprising the steps of:

a. providing a print head defining a plurality of ink ejection chambers therein, each ink ejection chamber adapted to eject a plurality of ink drops therefrom for forming a plurality of ink marks at a plurality of locations on a recording media;

b. aligning a plurality of spaced-apart, parallel heaters in a row transversely with respect to the recording media for heating the ink marks to dry the ink marks; and c. electrically connecting a controller to each of the heaters for generating a plurality of electrical pulses selectively energizing the heaters according to the locations of the ink marks on the recording media, so that the heaters dry only the locations having ink marks.

42. The method of claim 41, further comprising the steps of a. disposing an elongate bar near the heaters and extending transversely with respect to the recording media; and b. slidably engaging a sensor with the bar, the sensor being adapted to slidably reciprocate along the bar transversely with respect to the recording media for generating an electrical pulse upon sensing each of the locations of the ink marks on the recording media, the sensor being coupled to each of the heaters for transmitting the electrical pulses to the heaters corresponding to the locations of the ink marks.

43. The method of claim 41, further comprising the step of electrically connecting a plurality of sensors to respective ones of the heaters for generating a plurality of electrical pulses upon sensing the locations of the ink marks on the recording media.

44. The method of claim 43, further comprising the step of electrically connecting the controller to each of the sensors for receiving the electrical pulses generated by the sensors and for transmitting the electrical pulses to respective ones of the heaters for informing the heaters of the locations of the ink marks on the recording media as the sensors sense the ink marks.

45. The method of claim 41, further comprising the step of electrically connecting the controller to each of the ink ejecting chambers for generating a plurality of electrical pulses for selectively electrically energizing the ink ejection chambers and for electively informing the heaters of the ink ejection chambers electrically energized, so that the heaters are informed of the locations of the ink marks on the recording media as the ink ejection chambers form the ink marks.

46. The method of claim 41, wherein the step of aligning the plurality of spaced-apart, parallel heaters comprises the step of aligning a plurality of thermal resistance heaters.

47. The method of claim 41, wherein the step of aligning the plurality of spaced-apart, parallel heaters comprises the step of aligning a plurality of microwave heaters.

48. The method of claim 41, wherein the step of aligning the plurality of spaced-apart, parallel heaters comprises the step of aligning a plurality of infra-red radiant heaters.

* * * * *